United States Patent [19]

Jones

[11] 4,265,424

[45] May 5, 1981

[54] BLOWOUT PREVENTER AND IMPROVED RAM PACKER STRUCTURE

[75] Inventor: Marvin R. Jones, Houston, Tex.

[73] Assignee: Cameron Iron Works, Inc., Houston, Tex.

[21] Appl. No.: 8,249

[22] Filed: Feb. 1, 1979

[51] Int. Cl.[3] ..... E21B 33/06

[52] U.S. Cl. ..... 251/1 A

[58] Field of Search ..... 251/1 R, 1 A, 1 B, 175; 277/126–129

[56] References Cited

U.S. PATENT DOCUMENTS

| | | | |
|---|---|---|---|
| 1,087,021 | 2/1914 | Kerbaugh | 251/175 |
| 2,107,200 | 2/1938 | Kennon | 251/332 |
| 2,278,050 | 3/1942 | Allen et al. | 277/129 X |
| 2,690,320 | 9/1954 | Shaffer | 251/1 A |
| 2,760,751 | 8/1956 | Wilde | 277/127 X |
| 3,102,709 | 9/1963 | Allen | 251/175 X |
| 3,379,255 | 4/1968 | Burns et al. | 166/55 |

*Primary Examiner*—William R. Cline
*Assistant Examiner*—H. Jay Spiegel
*Attorney, Agent, or Firm*—Vinson & Elkins

[57] ABSTRACT

A blowout preventer having a housing with a bore extending therethrough and guideways intersecting the bore, a ram in each of the guideways, a packer in the face of each of the rams, a recess between the back of each packer and the face of the ram into which the packer can expand to partially reduce the sealing pressure on the packers and at least one passage communicating from the bore below the guideways to the recess to transmit well pressure to the recess.

12 Claims, 9 Drawing Figures

Fig. 4
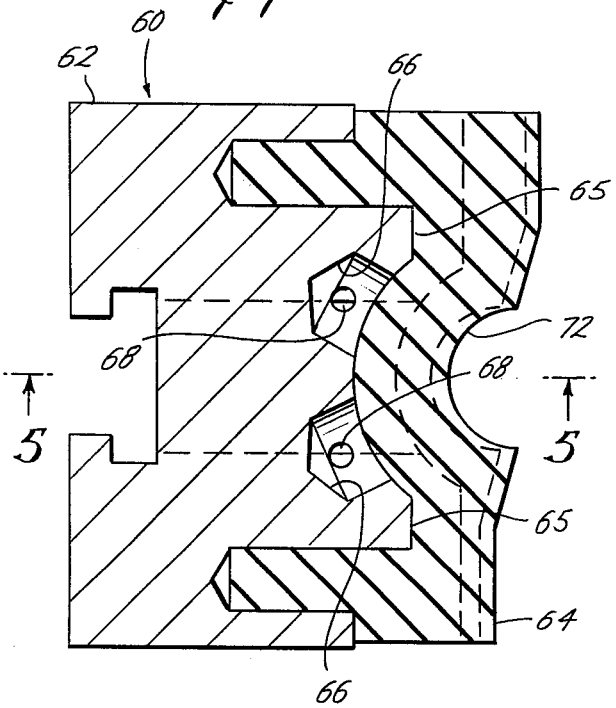
Fig. 6
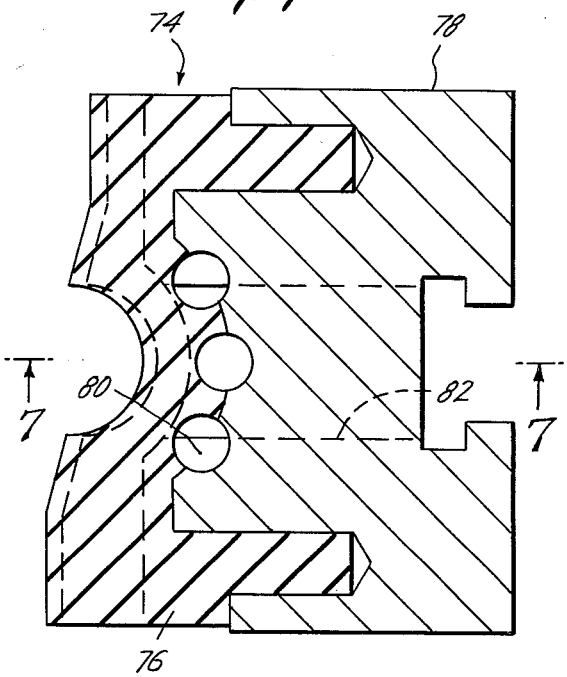
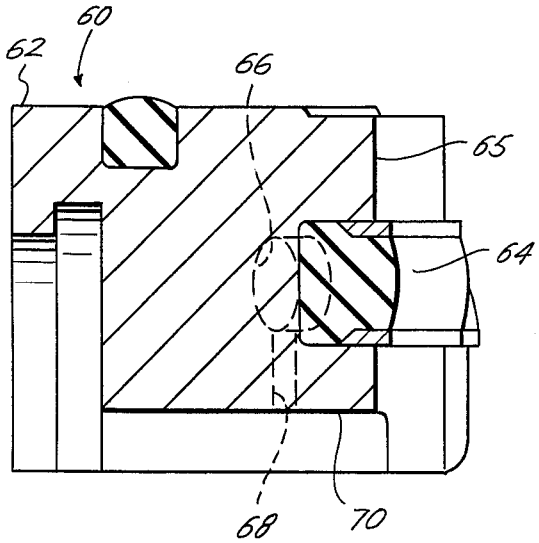
Fig. 5
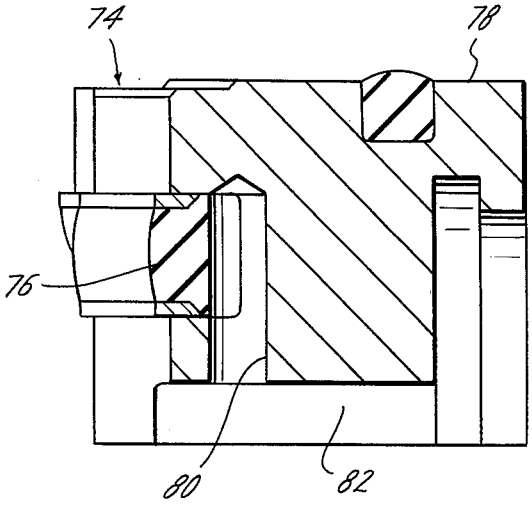
Fig. 7

Fig. 8
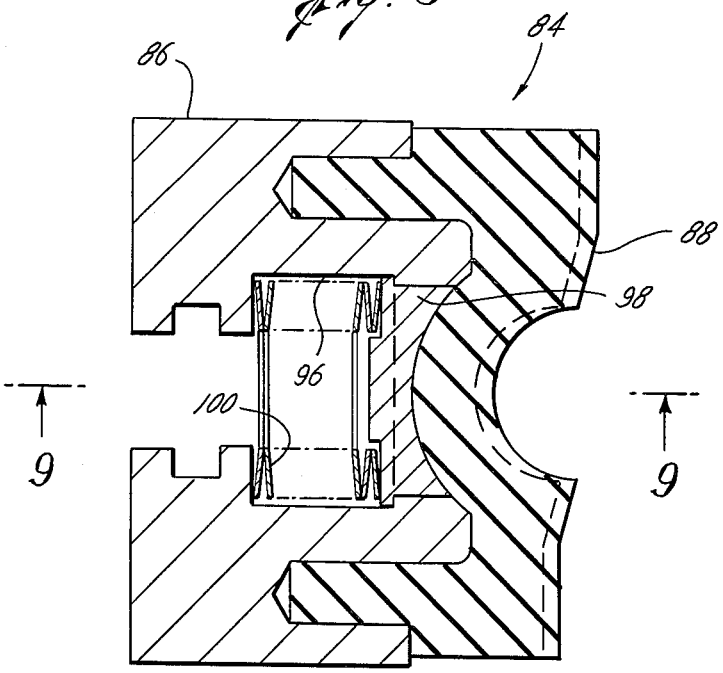
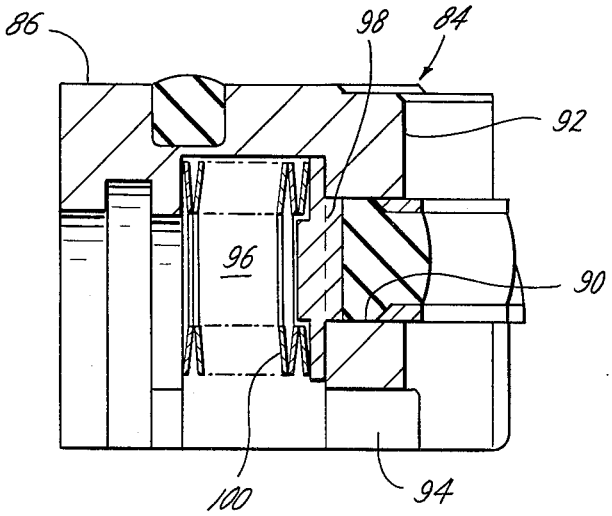
Fig. 9

BLOWOUT PREVENTER AND IMPROVED RAM PACKER STRUCTURE

BACKGROUND

Blowout preventers have long utilized the well pressure being contained to urge the packers into tighter engagement. In some prior structures, the entire ram back has been exposed to well pressure which has resulted in too much closing force. In other prior structures well pressure has been excluded from the back of the ram so that no force from the well pressure is exerted on the ram. Excessive pressure on the packers has caused rapid wear from moving the pipe engaged by the packers at high contained well pressure and severe extrusion damage where the resilient material bridges spaces when there is a high pressure differential across the ram.

The H. Allen U.S. Pat. No. 3,102,709 discloses a two piece ram with a portion of the well pressure force being applied to a plate which is movable a short distance axially with respect to the rest of the ram. This structure reduces the pressure force on the packer when the rams are closed against high pressure and thus reduces wear. However, closing these rams with no pipe extending through the preventer's bore and with full ram piston closing pressure damages the ram front packing by deforming the unsupported portion and excessively straining the pipe engaging area.

The A. L. Burns, Jr. et al U.S. Pat. No. 3,379,255 also allows pressure on the back side of the ram but differs in that the ram piston force is applied directly to the packing. With this structure, the operator by proper control of the piston pressures may be able to control the sealing pressures on the packing face to acceptable limits.

Examples of other prior art blowout preventers which transmit well pressure to the back side of the ram are the H. Allen U.S. Pat. No. 2,387,106, the H. Allen U.S. Pat. No. 2,322,269, the G. E. Nevill et al U.S. Pat. No. 2,318,882 and the K. T. Penick et al U.S. Pat. No. 2,193,110.

The H. Allen et al U.S. Pat. No. 2,278,050 discloses a blowout preventer ram packing having recesses at its back face which may be filled with cork. The stated purpose is "... to afford an elasticity to feed the rubber forward in the event of wear and to maintain a seal.". There is also a suggestion to provide the well pressure to the piston chamber but there are no passages provided to conduct well pressure to the recesses.

SUMMARY

The present invention relates to an improved blowout preventer and to an improved ram packer. The preventer includes a housing with a bore and opposed guideways intersecting the bore, a ram in each guideway and an improved packer mounted in the face of the ram. At least one recess is provided between the back of the packer and the face of the ram and a passage communicates to the recess from the well bore below the guideways. Such recess may be in the packer, in the ram or in adjacent portions of both the packer and the ram.

An object of the present invention is to provide an improved blowout preventer which utilizes well pressure for pressure energizing of the packer and provides an incremental seal loading at the packer face.

A further object is to provide an improved blowout preventer having a pressure energizing of the packer without excessive wear or packer extrusion.

Another object is to provide an improved packer for use as a replacement in a blowout preventer which has pressure energizing without excessive sealing pressures.

Still another object is to provide an improved blowout preventer which limits the pressure on the ram front packing which results from the forces applied to it by the ram.

BRIEF DESCRIPTION OF THE DRAWINGS

These and other objects and advantages of the present invention are hereinafter set forth and explained with reference to the drawings wherein:

FIG. 4 is a horizontal sectional view of a modified form of ram and packer assembly.

FIG. 5 is a sectional view of the ram and packer assembly taken along line 5—5 in FIG. 4.

FIG. 6 is a horizontal sectional view of another modified form of ram and packer assembly.

FIG. 7 is a sectional view of the ram and packer assembly taken along line 7—7 in FIG. 6.

FIG. 8 is a horizontal sectional view of still another modified form of ram and packer assembly.

FIG. 9 is a sectional view of the ram and packer assembly taken along line 9—9 in FIG. 8.

DESCRIPTION OF THE PREFERRED EMBODIMENTS

Figure 1:
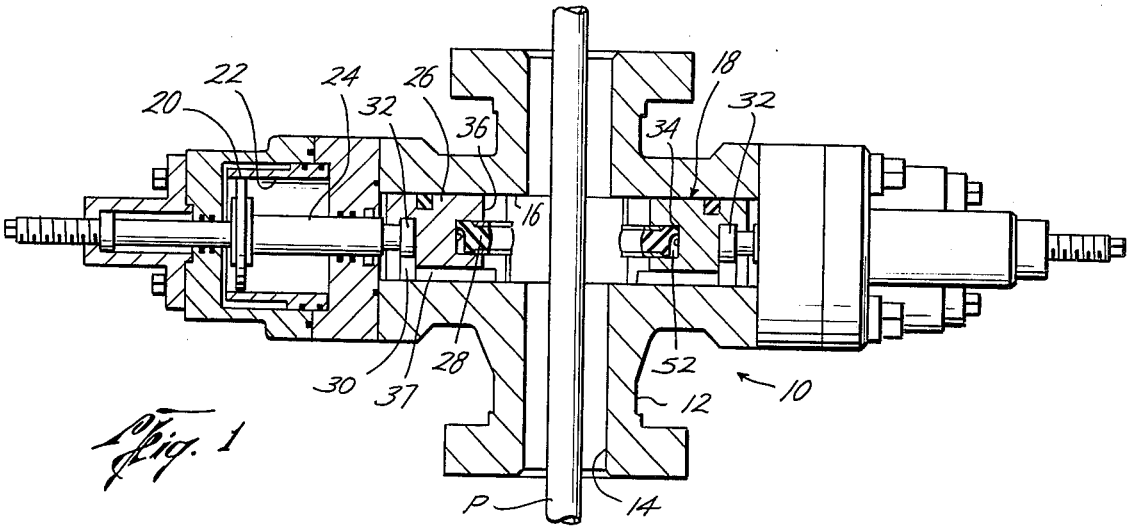
FIG. 1 is an elevation view of the preferred form of blowout preventer of the present invention with portions thereof broken away to show the improved ram packer.

The preferred form of the improved blowout preventer 10 of the present invention shown in FIG. 1 includes housing 12 having bore 14 extending therethrough and opposed guideways 16 intersecting bore 14. Ram assemblies 18 are mounted within opposed guideways 16 and are adapted to slide therein into position closing bore 14 and from such position to open bore 14. Each ram assembly 18 is reciprocated in its guideway by a piston 20 operating in cylinder 22 and connected to ram assembly 18 by rod 24. Each ram assembly 18 includes a ram 26 and a packer 28. Ram 26 has a slot 30 in its back to receive enlargement 32 on the end of rod 24. Thus, pistons 20 are moved responsive to fluid pressure applied to their alternate sides to move rams 24 into and from sealing position around pipe P extending through bore 14. Rams 24 each have a recess 34 extending across their front faces 36 into which improved packer 28 is positioned. Each ram 18 has a passage 37 in its bottom to admit well pressure from bore 14 to the back of ram 18.

Figure 2:
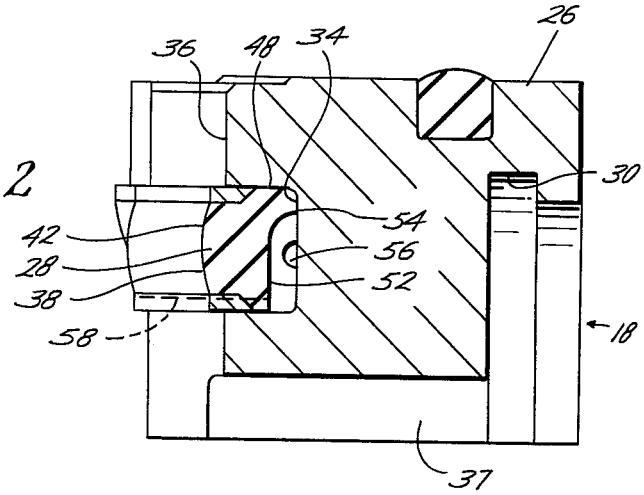
FIG. 2 is a detailed sectional view of one of the ram assemblies shown in FIG. 1.
Figure 3:
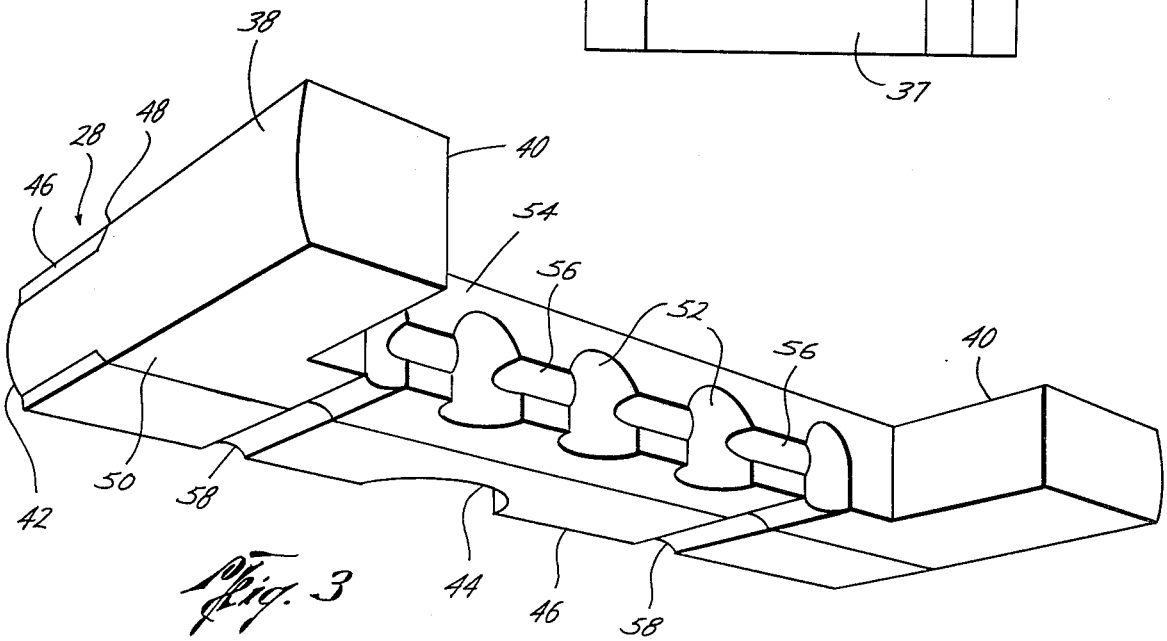
FIG. 3 is a perspective view of the preferred form of ram packer to show the grooves on its bottom and the recesses in its back.

Packer 28 (shown in FIGS. 2 and 3) includes body 38 of resilient material usually used in packers for blowout preventers. Body 38 is generally rectangular in both vertical and horizontal sections and has rearward projections 40 to mate with recesses in ram 24. Face 42 of body 38 has a pipe receiving recess 44. Plates 46 are preferably inset in body 38 along upper surface 48 and lower surface 50 and have the same face contour as body 38. Plates 46 function to contain body 38 when it is subjected to a substantial pressure differential on closing.

Recesses 52 are formed in back 54 of body 38 and are connected by grooves 56. Bottom surface 50 of packer 28 has grooves 58 extending from face 42 to the outer two of recesses 52. This provides communication from bore 14 to recesses 52 so that when ram assemblies 18 are closed well pressure below guideways 16 is communicated to the recesses.

Recesses 52 are provided so that when ram assemblies 18 are closed and subjected to the force on pistons 20 and the shut-in well pressure, packer body 38 has some space into which it may move to limit the sealing pressures on faces 42 of opposing packers 36. The well fluid pressure in recesses 52 and the shear strength of the material in packer 36 coact to reduce the sealing pressure on the packer face from a multiple of the well pressure to an increment above the well pressure. The sizes of the recesses are such that packer 36 includes approximately 15% void space when ram assemblies 18 are closed.

Figure 10:
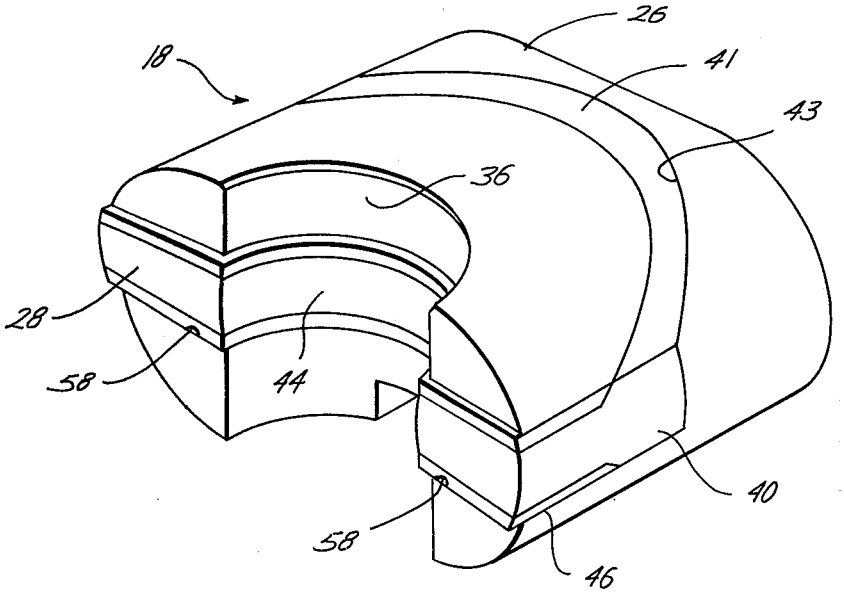
FIG. 10 is a perspective view of a ram and packer assembled to show the relationship between the packer side seals and the top seal.

As shown in FIG. 10, the projections 40 on packer 36 provide the side packing for ram 24 and a seal 41 is positioned in groove 43 across the top of ram 24 and abuts projections 40 on each side of ram 24. Thus, when ram assemblies 18 are closed on pipe P extending through bore 14 a pressure seal is provided to shut-in well pressure below blowout preventer 10.

A modified form of improved ram assembly of the present invention is shown in FIGS. 4 and 5. Ram assembly 60 includes ram 62 with packer 64 mounted in its face 65. Face 65 has recesses 66 formed therein with the passages 68 communicating from recesses 66 to groove 70 in the bottom of ram 62. Thus well pressure below ram assembly 60 is provided to the recesses 66 through groove 70 and passages 68. Packer 64 is of the usual resilient material and has pipe receiving recess 72 in its face 65.

In the form illustrated in FIGS. 6 and 7 ram assembly 74 includes packer 76 positioned in the face of ram 78. The recesses behind packer 76 are holes 80 formed in ram 78 and packer 76 and communicate from passage 82 in the bottom of ram 78.

Ram assembly 84 shown in FIGS. 8 and 9 includes ram 86 and packer 88. Packer 88 is positioned in slot 90 in face 92 of ram 86. Ram 86 is formed to have passage 94 along its bottom and in communication with recess or opening 96 in which support button or disc 98 is positioned. Support button 98 has a contour mating with the back of packer 88 and is urged against the back of packer 88 by spring 100 and the pressure within the opening 96.

In each form of ram assembly of the present invention as shown, a recess is provided behind the packer which is exposed to well pressure. This recess may be formed in the packer, in the ram or in adjacent surfaces of both the packer and the ram. This recess allows the sealing pressure at the face of the packers to be higher than the well pressure by a preselected constant increment. Also, in all embodiments disclosed, pressure from the bore of the housing below the guideways is communicated both to the back side of the packer and the back side of the ram.

What is claimed is:

1. A blowout preventer comprising a housing having a bore extending therethrough and opposed guideways intersecting the bore, a ram slidably mounted in each of the guideways, a packer positioned in the face of each of the rams, each packer having on its face a surface for sealing against an opposite packer or a tubular member in the bore, at least one recess between the adjacent faces of each ram and packer, and at least one passage communicating from the housing bore below the rams to each recess and thereby to the back of the packer, each recess being sufficiently large to allow movement of its packer to reduce the sealing pressures on the face of the packer to approximate an increment above well pressure.

2. A blowout preventer according to claim 1 wherein at least a portion of each recess is in the associated packer.

3. A blowout preventer according to claim 1 wherein at least a portion of each recess is in the associated ram.

4. A blowout preventer according to claim 1 wherein each recess is in one of the associated ram, the associated packer and both the associated ram and the associated packer.

5. A blowout preventer according to claim 1 including a disc positioned in each recess against a portion of the back of the packer, and means resiliently urging the discs against their packer.

6. A blowout preventer according to claim 1 wherein each packer has a plurality of recesses on its back, each of said recesses terminating below the top of the packer, a plate positioned in the lower portion of the packer at its face, a groove extending across the lower portion of the plate and the packer communicating with at least one of said recesses.

7. A blowout preventer according to claim 6 including grooves in the back of each packer between each of said recesses to assure communication to said recesses from the housing bore immediately below the face of the packer.

8. A packer for a blowout preventer ram comprising a body of resilient material being generally rectangular in shape with a vertical recess in the face thereof for engaging a pipe and projections extending from each side of the back for interdigitating with holes in the ram, a plurality of recesses in the back of the body terminating short of the top of the body, a pair of plates positioned in recesses in the top and bottom of the body and having their forward edges substantially the same shape as the shape of the body face, and means providing communication from the lower edge of the face to the recesses in the back of the body.

9. A packer according to claim 8 wherein said communication means includes grooves in the bottom of the body extending from the body face to said recesses.

10. A blowout preventer comprising a housing having a bore extending therethrough and opposed guideways intersecting the bore, a ram slidably mounted in each of the guideways, a packer positioned in the face of each of the rams, at least one recess between the adjacent faces of each ram and packer, each recess being formed in the ram or the packer, and at least one passage communicating from the housing bore below each ram to each recess, each recess being sufficiently large to allow movement of its packer to reduce the sealing pressures on the face of the packer to approximate an increment above well pressure.

11. A blowout preventer, comprising a housing having a bore extending therethrough and opposed guideways intersecting the bore, a ram slidably mounted in each of the guideways, a packer positioned in the face of each of the rams, each packer including a body of resilient material being generally rectangular in shape with a vertical recess in the face thereof for engaging a pipe and projections extending from each side of the back for interdigitating with holes in its associated ram, a plurality of recesses in the back of each packer body terminating short of the top of the body, a pair of plates positioned in recesses in the top and bottom of each packer body and having their forward edges substantially the same shape as the shape of the body face, and means providing communication from the lower edge of the face of each of the packer bodies to each of the recesses in the back of the packer body.

12. A blowout preventor according to claim 11 wherein said communication means includes grooves in the bottom of each packer body extending from the body face to the recesses.

* * * * *